US005990763A

United States Patent [19]

Sipilä

[11] Patent Number: 5,990,763

[45] Date of Patent: Nov. 23, 1999

[54] FILTER HAVING PART OF A RESONATOR AND INTEGRAL SHELL EXTRUDED FROM ONE BASIC BLOCK

[75] Inventor: Juha Petri Sipilä , Kempele, Finland

[73] Assignee: ADC Solitra OY, Kempele, Finland

[21] Appl. No.: 08/691,938

[22] Filed: Aug. 5, 1996

[51] Int. Cl.[6] ..... H01P 1/205

[52] U.S. Cl. ..... 333/202; 333/203; 333/234

[58] Field of Search ..... 333/202, 203, 333/206–209, 212, 219, 222, 223, 227, 230, 231, 234

[56] References Cited

U.S. PATENT DOCUMENTS

| | | | |
|---|---|---|---|
| 3,571,768 | 3/1971 | Gundry | 333/230 |
| 4,034,319 | 7/1977 | Olsson | 333/203 |
| 4,278,957 | 7/1981 | Starai | 333/202 |
| 4,280,113 | 7/1981 | Sekiguchi | 333/212 X |
| 4,292,610 | 9/1981 | Makimoto et al. | 333/234 X |
| 4,307,357 | 12/1981 | Alm | 333/206 |
| 4,398,164 | 8/1983 | Nishikawa et al. | 333/206 X |
| 4,706,051 | 11/1987 | Dielman | 333/212 |
| 5,329,687 | 7/1994 | Scott | 29/527.2 |
| 5,502,715 | 3/1996 | Penny | 370/26 |

FOREIGN PATENT DOCUMENTS

| | | | |
|---|---|---|---|
| 2638024 | 4/1990 | France . | |
| 59/223002 | 12/1984 | Japan | 333/203 |
| 2 067 848 | 7/1981 | United Kingdom | 333/203 |
| WO 93/01625 | 1/1993 | WIPO | 333/203 |

*Primary Examiner*—Robert Pascal
*Assistant Examiner*—Barbara Summons
*Attorney, Agent, or Firm*—Ladas & Parry

[57] ABSTRACT

The invention relates to a filter and a method for manufacturing a filter. The filter comprises a shell construction with a wall construction and a bottom portion, which form at least one section in the shell construction. The filter further comprises at least one resonator within a section of the shell construction. At least the bottom portion of the shell construction and one or more resonators, or at least the part thereof close to the bottom portion of the shell construction, are an integral unit extruded from the same basic block in one piece.

5 Claims, 2 Drawing Sheets

FILTER HAVING PART OF A RESONATOR AND INTEGRAL SHELL EXTRUDED FROM ONE BASIC BLOCK

BACKGROUND OF THE INVENTION

The invention relates to a filter comprising a shell construction with a wall construction and a bottom portion forming at least one section in the shell construction, said filter further comprising at least one resonator within a section of the shell construction.

The invention also relates to a method for manufacturing a filter comprising producing a shell construction with a wall construction, a bottom portion and at least one section, and at least one resonator in said shell construction.

Radio frequency filters are used for implementing high-frequency circuits for instance in base stations of mobile telephone networks. Filters can be used, for example, as interface and filtering circuits in the amplifiers of transmitter and receiver units in base stations.

There are several different types of resonator filters comprising a shell construction, or body, e.g. coaxial resonator filters. In coaxial resonator filters, the shell envelops a conductor which is positioned in a section of the shell and which is called a resonator or resonator pin. High-frequency filters, for example, particularly more complicated filters, are provided with a multi-section shell construction and so-called subdivision. In this case, the resonator filter has a multi-section, or multi-cavity, shell construction; in other words, it comprises a plurality of resonator cavities, or sections in the shell construction, each of which forms a separate resonant circuit with the corresponding resonator.

In some known coaxial resonator filters, the shell construction and the resonators are made of separate pieces, wherefore the resonators must be, for instance, soldered onto the bottom of the shell construction. Such a construction increases the probability of detrimental intermodulation and is slow to manufacture. There are also known solutions in which material is milled away from a sufficiently large metal block so that the remaining part of the block constitutes the shell construction and resonator pins of the filter. Such a solution consumes a great deal of raw material and requires time-consuming manufacturing steps.

U.S. Pat. No. 4,706,051 discloses a solution according to which halves of a waveguide shell construction are manufactured by forging into a die: a slug of material is hit by a punch such that the slug material is displaced in the closed space between the die and the punch. This publication does not disclose any solution for manufacturing resonators. The solution according to this publication has drawbacks, since it involves the manufacture of complementary halves of a shell, and since the slug material displaced as a result of punching to form a half of the shell construction does not flow freely, since the flow of the material is restricted by the closed die.

U.S. Pat. No. 5,329,687 discloses a solution according to which both a shell construction and a resonator are moulded or extruded from plastic as an integral unit to be coated with metal. However, the thermal conductivity of such a construction is not good. In addition, U.S. Pat. No. 4,278,957 discloses a solution according to which resonators are cast in the shell construction. The construction of the last-mentioned publication is manufactured by die casting, which requires a multielement die arrangement which must open in at least three directions. On account of the material residues left in the joints of the die, a resonator made by die casting will not be entirely circular, which impairs the electrical properties of the resonator.

SUMMARY OF THE INVENTION

The object of the present invention is to provide a new type of filter which avoids the problems associated with the known solutions.

This is achieved with the filter of the invention, which is characterized in that at least the bottom portion of the shell construction and one or more resonators, or at least the part thereof close to the bottom portion of the shell construction, are an integral unit extruded from the same basic block in one piece.

This is also achieved with a method of the invention for manufacturing a filter, said method being characterized in that at least the bottom portion of the shell construction and the resonator, or at least the part thereof close to the bottom portion of the shell construction, are manufactured by impact extrusion from the same basic block in one piece.

The solution of the invention has several advantages. The method of the invention solves the problem pertaining to the joint between the lower ends of the resonators and the shell. When manufactured by the method of the invention, the shell and the resonator, or at least the lower end of the resonator, are integral, wherefore no soldered joint or any other joint is needed between the lower end of the resonator and the bottom portion of the shell construction. The method of the invention allows the number of separate parts to be reduced in the products, and the intermodulation problems with the product are clearly less serious than in the case of products assembled from separate parts. In addition, the solution of the invention saves raw materials as compared with the milling method. The solution of the invention also improves the quality factor of the filter, as no joint is needed between the lower end of the resonator and the bottom of the shell construction. The new solution reduces the weight of the filter and the number of manufacturing steps. The invention provides better thermal conductivity as compared with known solutions extruded from plastic and coated with an electroconductive material such as metal. In the solution of the invention, the shell construction and resonators can be formed by a single motion, and the die has to open in only one direction. The solution of the invention allows the cross-section of the resonators to be made completely circular. The preferred embodiments and other more detailed embodiments of the invention emphasize the advantages of the invention.

In the following, the invention will be described in greater detail with reference to the accompanying drawings, in which

DETAILED DESCRIPTION OF THE INVENTION

FIGS. 1, 2, 4 and 5 illustrate a filter 1 comprising a shell construction 2 with a wall construction 3 and a bottom portion 4. The wall construction 3 and the bottom portion 4 form at least one section in the shell construction 2, in this case four sections 11–14, or resonator cavities 11–14. The filter 1 further comprises at least one resonator, or conductor means, in this case four resonators 21–24, located within the sections 11–14 of the shell construction 2. The bottom portion 4 of the shell construction 2 refers to the side of the shell construction 2 from which the resonators 21–24 extend towards the other end of the cavity.

Figure 3:
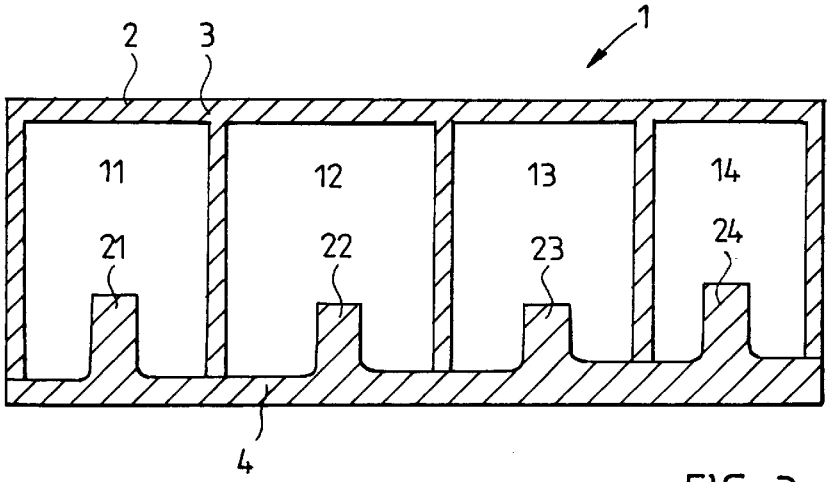
FIG. 3 shows a cross-section of a third embodiment of the invention, in which the resonators and the bottom portion of the shell construction have been manufactured in the same step.

According to the invention, at least the bottom portion 4 of the shell construction 2 and one or more resonators 21–24, or at least the parts thereof close to the bottom portion 4, form an integral unit extruded from the same basic block 15 in one piece. FIG. 3 shows a version in which only the bottom 4 of the shell is of the same extruded piece as the resonators 21–24. Whether part 4 is taken as the cover or as the bottom is a question of definition.

The method for manufacturing a filter comprises producing a shell construction 2 comprising a wall construction 3, a bottom portion 4 and at least one section, in this case four sections 11–14, and at least one resonator, in this case four resonators 21–24, in the shell construction 2. At least the bottom portion 4 of the shell construction and the resonators 21–24, or at least the parts thereof close to the bottom portion 4 of the shell construction, are manufactured by impact extrusion from the same basic block 15 in one piece. FIG. 3 illustrates a 'minimum version' of this kind, where only the bottom portion 4 is of the same extruded piece as the resonators 21–24.

In the preferred embodiments shown in FIGS. 1, 2, 4 and 5, the walls 3 and the bottom portion 4 of the shell construction and one or more resonators, at least partly, have been extruded from the same basic block 15 in one piece. The walls 3 of the shell construction are thus extruded from the same basic block 15, wherefore no joint is needed between the bottom portion 4 and the wall 3, since the resonators, the bottom portion 4 and the wall construction 3 are of the same integral unit, extruded in one piece.

It appears from the figures that the invention preferably relates to a multi-circuit filter 1 which comprises a plurality of resonators, and the shell construction 2 of which comprises a plurality of sections 11–14. The solution is most preferably such that the shell construction 2 with its different sections 11–14 and several resonators, either entirely or partly, are extruded from the same basic block 15 in one piece. Most preferably the method thus comprises manufacturing a multi-circuit high-frequency filter comprising a plurality of sections 11–14 and a plurality of resonators, the shell construction 2 with its sections 11–14 and the resonators 21–24 being manufactured by impact extrusion from the same basic block in one piece. In a multi-circuit resonator filter, the resonant circuits are coupled to one another in such a manner that the resonator filter provides the desired frequency response in the frequency band. Each resonant circuit is coupled to the following resonant circuit in the switching diagram.

Most preferably, the basic block is of metal, whereby the shell construction 2 of the filter and one or more resonators, either entirely or partly, are extruded from a basic block 15 of metal. It is therefore not necessary to apply any thick coatings to the resonators and the shell construction 2. However, a coating can be provided to improve the electroconductivity of the basic metal.

In order to improve the practicability of the method, the shell construction 2 with its one or more sections 11–14, i.e. the walls, and one or more resonators are preferably extruded in the same manufacturing step. Most preferably, the shell construction 2, either entirely or partly, and one or more resonators, either entirely or partly, are extruded by the same tool arrangement 30-31. In the examples of FIGS. 1, 2, 4 and 5, the resonators 21–24, the bottom portions 3 of the shells, and also the wall portions of the shells are extruded from the same metal block in the same manufacturing step.

Figure 5:
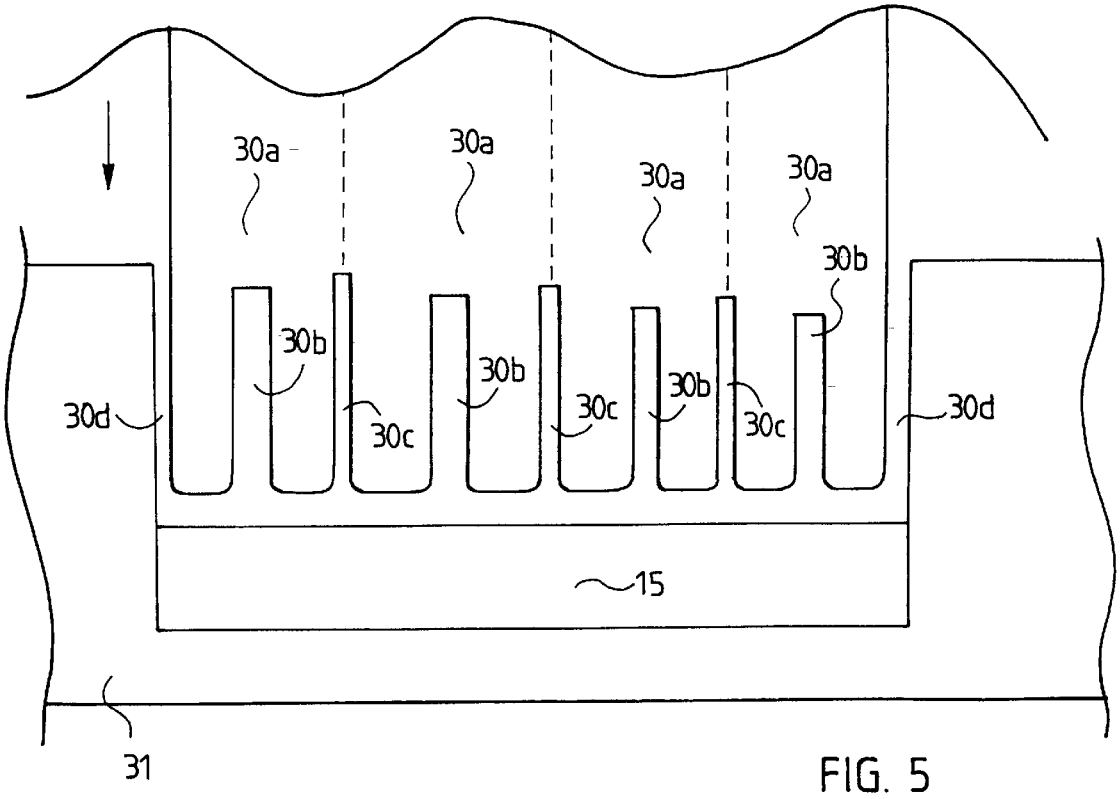
FIG. 5 illustrates a method for manufacturing a resonator.

FIG. 5 illustrates a method for manufacturing a resonator, wherein the tool arrangement 30-31 comprises an impactor means 30 striking from the top downwards, and an underlayer 31 provided with a recess in which the metal basic block 15 is preferably positioned. The impactor means 30 comprises a number of impact surfaces 30*a* corresponding to the number of resonators and sections (four). Each impact surface comprises a middle space 30*b*. The different impact surfaces 30*a*, i.e. punches, are separated from each other by intermediate spaces 30*c*. Between the outermost impact surfaces and the underlayer 31 there are lateral spaces 30*d*.

Figure 1:
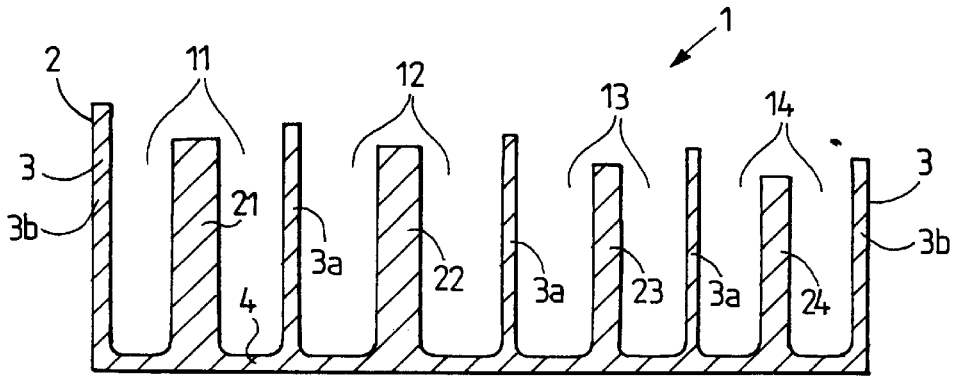
FIG. 1 shows a cross-section of a first embodiment of the invention, in which the entire resonator has been manufactured in the same step as the shell construction.
Figure 2:
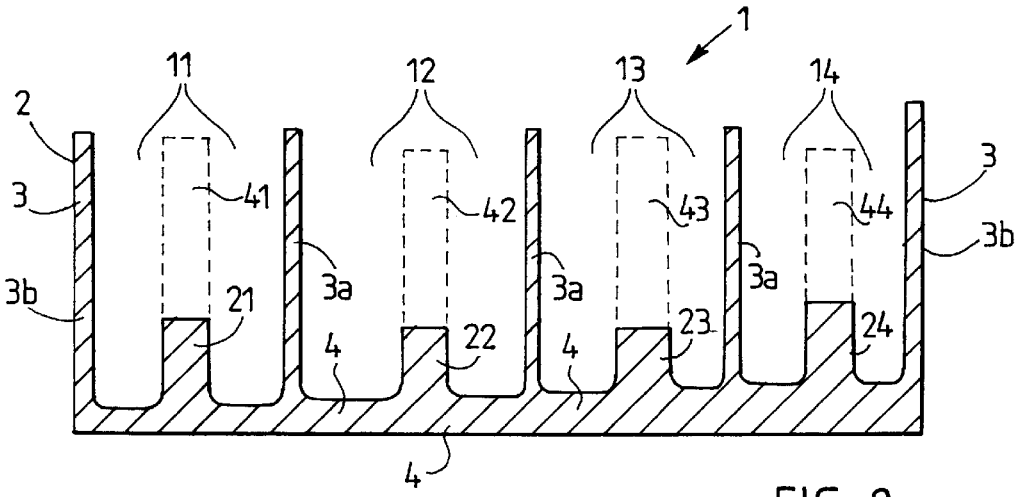
FIG. 2 shows a cross-section of a second embodiment of the invention, in which only the lower end of the resonator has been manufactured in the same step as the shell construction.
Figure 4:
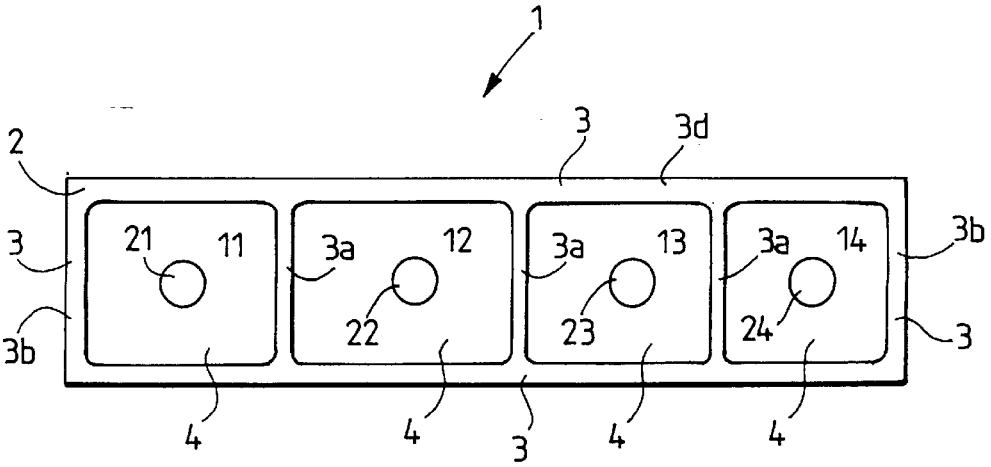
FIG. 4 is a top view of a filter.

The extrusion is performed by subjecting the basic block 15, preferably of metal, on the hard underlayer to intense compression by means of the tool arrangement 30-31. The compression forces the material of the basic block 15 to the spaces 30*b*, 30*c*, 30*d* provided in the tool arrangement 30-31 and/or in its vicinity. The spaces 30*b*, 30*c*, 30*d* are filled with the material of the basic block 15 either entirely or partly, forming thus entirely or partly one or more resonators in the shell construction 2. The material forced from the basic block 15 to the middle spaces 30*b* of the impactor tool 30, 30*a* forms the resonators 21–24 either entirely or partly. In FIGS. 1 and 3, the resonators are produced entirely by the extrusion. In FIG. 2, only part of the resonators 21–24 are produced by the extrusion. The material forced from the basic block 15 to the intermediate spaces 30*c* forms the intermediate walls 3*a* of the shell construction. The material forced to the spaces 30*d* between the impactor tool 30, 30*a* and the underlayer forms the lateral walls 3*b*, 3*d* of the shell construction.

It can be seen from FIG. 2 that in the filter according to the preferred embodiment at least one of the resonators 21–24 comprises an additional portion 41–44 added to the part of the resonator produced by extrusion. In practice, all the resonators of FIG. 2 have an additional portion 41–44. The additional portions can be used for improving the temperature stability of the filter. One or more of the additional portions 41–44 provided in the resonators 21–24 are preferably of a metal or other material with a lower temperature coefficient, whereby the temperature properties of the filter can be adjusted.

Resonators 21–24 of unequal length are used for providing the desired frequency response. In the example illustrated in FIG. 1, the lengths of the resonators are already determined during the extrusion step. In the embodiment shown in FIG. 1, resonators of unequal length are produced by using middle spaces, or middle recesses 30*b*, of unequal depth. This embodiment simplifies the method, as it is not necessary to shorten the resonators in order to obtain resonators of unequal length.

According to the method of the invention, a multi-cavity shell and the resonators, or part of the resonators, of a high-frequency filter are manufactured by impact extrusion with the same tool and in the same step. The method is therefore simple, and the filter produced is an integral unit.

FIG. 2 can be alternatively taken to illustrate a filter extruded in such a way that the material 3, 3*a*, 3*b*, 3*d* for forming the shell construction is allowed to flow substantially freely in the vertical direction of the shell construction.

This requires a punch that, in addition to the outer walls 3*b*, 3*d* of the shell construction 3, allows even the intermediate walls 3*a* to grow freely upwards. In this case, the shell construction is preferably extruded such that it becomes overlong, and the extra length is cut off. This embodiment simplifies the manufacture. The die construction is thus open in a sense.

The filter of the invention can be used, for example, in radio transmitters, receivers, or radio transceivers, such as base stations of a cellular radio network. It is obvious that in this case the filter also comprises an interface from the antenna, an RX interface, which gives the signal to a receiver of the base station, and a TX interface, to which the signal from the transmitter of the base station is supplied. In addition to a base station in a cellular radio network, the present invention can also be applied in another radio transceiver or device.

Although the invention has been described above with reference to the examples illustrated in the accompanying drawings, it will be clear that the invention is not limited to the examples, but can be modified in many ways within the scope of the inventive concept disclosed in the appended claims.

I claim:

1. A filter comprising:

a shell construction with a wall construction and a bottom portion forming at least one section in the shell construction; and at least one resonator of solid cross section within the section of the shell construction, wherein at least the bottom portion of the shell construction and at least part of the resonator at the bottom portion of the shell construction are an integral unit extruded from a basic block in one piece, and wherein the shell construction of the filter and one or more resonators either entirely or partly are extruded from a basic block of metal.

2. A filter according to claim 1, wherein the wall construction of the shell construction is also extruded from the basic block in the one piece.

3. A filter according to claim 1, wherein the filter is a multi-circuit filter comprising a plurality of resonators and a plurality of sections in the shell construction, and wherein the shell construction with the plurality of sections therein and several resonators, either entirely or partly, are extruded from the same basic block in one piece.

4. A filter, comprising:

a shell construction with a wall construction and a bottom portion forming at least one section in the shell construction; and at least one resonator of solid cross section within the section of the shell construction, wherein at least the bottom portion of the shell construction and at least part of the resonator at the bottom portion of the shell construction are an integral unit extruded from a basic block in one piece, wherein the shell construction of the filter and one or more resonators either entirely or partly are extruded from a basic block of metal, and wherein at least one of the resonators comprises an additional portion added to the resonator produced by extrusion.

5. A filter according to claim 4, wherein the additional portion added to the resonator is of a material whose thermal conductivity is different from that of the resonator material, the thermal conductivity of the additional portion being preferably lower than that of the resonator material.

* * * * *

US005990763C1

(12) EX PARTE REEXAMINATION CERTIFICATE (5041st)

United States Patent

Sipilä

(10) Number: US 5,990,763 C1

(45) Certificate Issued: Dec. 14, 2004

(54) FILTER HAVING PART OF A RESONATOR AND INTEGRAL SHELL EXTRUDED FROM ONE BASIC BLOCK

(75) Inventor: Juha Petri Sipilä, Kempele (FI)

(73) Assignee: ADC Solitra OY, Oulu (FI)

Reexamination Request:
No. 90/005,938, Feb. 20, 2001

Reexamination Certificate for:

| | |
|---|---|
| Patent No.: | **5,990,763** |
| Issued: | **Nov. 23, 1999** |
| Appl. No.: | **08/691,938** |
| Filed: | **Aug. 5, 1996** |

(51) Int. Cl.[7] ..... H01P 1/205

(52) U.S. Cl. ..... 333/202; 333/203; 333/234

(58) Field of Search ..... 333/202, 203, 333/206, 207, 209, 212, 219, 222, 223, 227, 230, 231, 234

(56) References Cited

U.S. PATENT DOCUMENTS 4,112,398 A 9/1978 Burnett et al.
4,398,164 A 8/1983 Nishikawa et al.
4,990,869 A * 2/1991 Chanteau et al. ..... 333/203

OTHER PUBLICATIONS

*Aluminum Impacts Design Manual and Application Guide*, Chapters 1–8, by the Forgings and Impacts Division of the Aluminum Association, located at 900 19th St., N.W., Washington, D.C. 20006.

* cited by examiner

*Primary Examiner*—Benny T. Lee

(57) ABSTRACT

The invention relates to a filter and a method for manufacturing a filter. The filter comprises a shell construction with a wall construction and a bottom portion, which form at least one section in the shell construction. The filter further comprises at least one resonator within a section of the shell construction. At least the bottom portion of the shell construction and one or more resonators, or at least the part thereof close to the bottom portion of the shell construction, are an integral unit extruded from the same basic block in one piece.

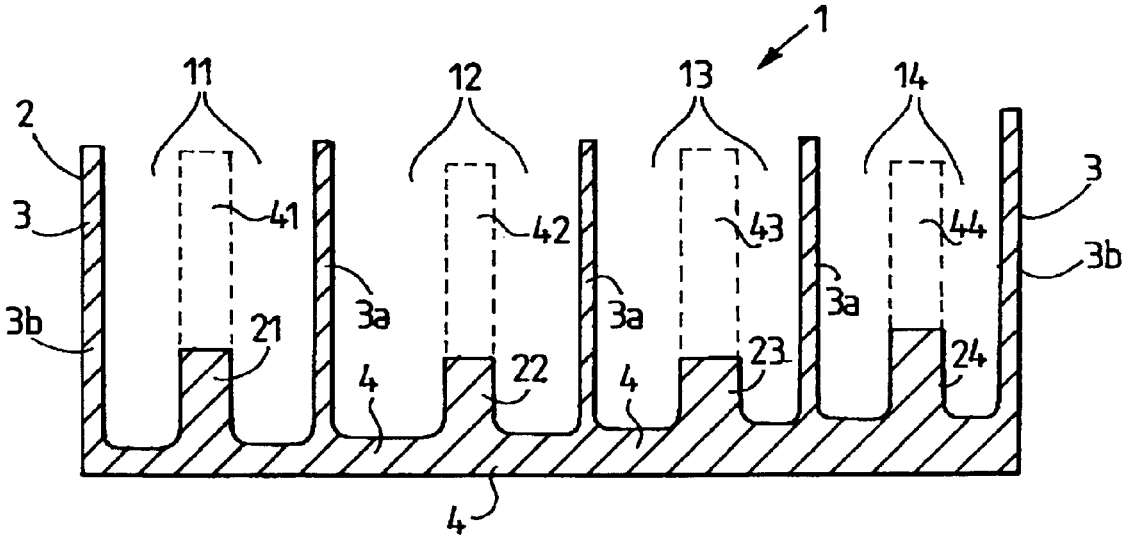

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 50–52:

FIG. 1 shows a cross-section of a first embodiment of the invention, in which the entire [resonator has] *resonators have* been manufactured in the same step as the shell construction, *the embodiment being asymmetric in a direction from one of the resonators toward any other thereof,*

Column 2, lines 53–56:

FIG. 2 shows a cross-section of a second embodiment of the invention, in which only [the] lower ends of the [resonator has] *resonators have* been manufactured in the same step as the shell construction, *the embodiment being asymmetric in a direction from one of the resonators toward any other thereof,*

Column 2, lines 57–60:

FIG. 3 shows a cross-section of a third embodiment of the invention, in which the resonators and the bottom portion of the shell construction have been manufactured in the same step, *the embodiment being asymmetric in a direction from one of the resonators toward any other thereof,*

Column 4, lines 50–58:

[Resonators] *In FIG. 2, resonators* 21-24 *are* of unequal [length are used] *lengths, i.e. heights from the bottom portion 4, which has respective thicknesses thereat, whereby both the resonators and the bottom portion are asymmetrical in a direction from one of the resonators toward any other thereto* for providing the desired frequency response. In the example illustrated in FIG. 1, the lengths of the resonators are already determined during the extrusion step. In the embodiment shown in FIG. 1, resonators of unequal length are produced by using middle spaces, or middle recesses 30b, of unequal depth. This embodiment simplifies the method, as it is not necessary to shorten the resonators in order to obtain resonators of unequal length.

AS A RESULT OF REEXAMINATION, IT HAS BEEN DETERMINED THAT:

Claim 3 is cancelled.

Claims 1 and 4 are determined to be patentable as amended.

Claims 2 and 5, dependent on an amended claim, are determined to be patentable.

New claims 6–20 are added and determined to be patentable.

1. A filter comprising:

a shell construction with a wall construction and a bottom portion forming at least [one] *two* sections in the shell construction; and at least [one] *two* resonators of solid cross sections *respectively* within the sections of the shell construction, wherein at least the bottom portion of the shell construction and at least part of the resonators at the bottom portion of the shell construction are an integral unit extruded from a basic block in one piece, [and]

wherein the shell construction of the filter and [one or more] *the* resonators either entirely or partly are extruded from a basic block of metal, *and*

*wherein at least one of the shell construction and the resonators is asymmetrical in a direction from one of the resonators toward any other thereof.*

4. A filter, comprising:

a shell construction with a wall construction and a bottom portion forming at least [one] *two* sections in the shell construction; and at least [one] *two* resonators of solid cross sections *respectively* within the sections of the shell construction, wherein at least the bottom portion of the shell construction and at least part of the resonator at the bottom portion of the shell construction are an integral unit extruded from a basic block in one piece, wherein the shell construction of the filter and one or more resonators either entirely or partly are extruded from a basic block of metal, [and]

wherein at least one of the resonators comprises an additional portion added to the resonator produced by extrusion, *and*

*wherein at least one of the shell construction and the resonators is asymmetrical in a direction from one of the resonators toward any other thereof.*

*6. A filter according to claim 1, wherein the shell construction is asymmetrical.*

*7. A filter according to claim 1, wherein the resonators are asymmetrical.*

*8. A filter according to claim 1, wherein the shell construction and resonators are asymmetrical.*

*9. A filter according to claim 6, wherein the bottom portion of the shell construction is asymmetrical.*

*10. A filter according to claim 8, wherein the bottom portion of the shell construction is asymmetrical.*

*11. A filter according to claim 9, wherein the bottom portion of the shell construction is asymmetrical by thickness.*

*12. A filter according to claim 10, wherein the bottom portion of the shell construction is asymmetrical by thickness.*

*13. A filter according to claim 7, wherein heights of the resonators from the bottom portion of the shell construction are asymmetrical.*

*14. A filter according to claim 8, wherein heights of the resonators from the bottom portion of the shell construction are asymmetrical.*

*15. A filter according to claim 10, wherein heights of the resonators from the bottom portion of the shell construction are asymmetrical.*

*16. A filter according to claim 12, wherein heights of the resonators from the bottom portion of the shell construction are asymmetrical.*

*17. A filter according to claim 4, wherein the shell construction is asymmetrical.*

*18. A filter according to claim 4, wherein the resonators are asymmetrical.*

*19. A filter according to claim 4, wherein the shell construction and resonators are asymmetrical.*

*20. A filter according to claim 17, wherein the bottom portion of the shell construction is asymmetrical.*

* * * * *